US006080946A

United States Patent [19]

Lee et al.

[11] Patent Number: 6,080,946

[45] Date of Patent: Jun. 27, 2000

[54] DIP SWITCH WITH ENHANCED ANTI-EMI PERFORMANCE

[75] Inventors: Chung-Wang Lee; Yu-Shuan Chang, both of Hsinchu, Taiwan

[73] Assignee: D-Link Corporation, Hsinchu, Taiwan

[21] Appl. No.: 09/379,316

[22] Filed: Aug. 23, 1999

[51] Int. Cl.[7] ..... H01H 9/00

[52] U.S. Cl. ..... 200/293

[58] Field of Search ..... 200/1 R, 5 A, 200/1 A, 6 R, 16 R, 18, 293–297, 302.1, 303, 304, 305, 307, 333, 334; 361/600, 679, 728, 736, 741, 748, 752, 753, 800, 816, 818, 837

[56] References Cited

U.S. PATENT DOCUMENTS 3,283,111 11/1966 Wirsching ..... 200/303
4,417,106 11/1983 Gingerich et al. ..... 220/5 R
4,772,761 9/1988 Ibrahim et al. ..... 174/52.4
5,602,722 2/1997 Sanpei et al. ..... 361/730
5,844,184 12/1998 Liau ..... 200/16 R

*Primary Examiner*—Michael Friedhofer
*Attorney, Agent, or Firm*—Bacon & Thomas

[57] ABSTRACT

A DIP switch having a metal cover with risers extended from sides adjacent to DIP switch urging against a housing of circuit board when DIP switch is seated on circuit board such that DIP switch is enclosed by metal cover, housing, and circuit board with only an opening provided on housing for setting selectors, and a portion of circuit board under DIP switch is obstructed from outside, thereby preventing an EMI generated by other devices on circuit board from interfering with DIP switch, as well as preventing an EMI generated by the portion of circuit board under DIP switch from emitting out of the opening.

3 Claims, 2 Drawing Sheets

DIP SWITCH WITH ENHANCED ANTI-EMI PERFORMANCE

FIELD OF THE INVENTION

The present invention relates to a switch and more particularly to a dual in-line package ("DIP") switch having a metal cover which may prevent an electromagnetic interference ("EMI") from interfering with the operation of switch and other adjacent devices.

BACKGROUND OF THE INVENTION

In general, a conventional DIP switch is made of plastic material and formed integrally with plastic housing. A number of selectors are disposed side-by-side on a top or side surface of housing. A number of pins, electrically connected to selectors, are provided on bottom surface of housing. Pins may insert into a number of corresponding holes in a circuit board for tightly securing switch on circuit board.

There is a disadvantage that because switch is plastic and an opening is provided on circuit board corresponding to selector DIP switch for permitting a user to use a finger or a pointed object like a ball-point pen to set DIP switch selectors in order to choose a desired function, an EMI may be generated from other devices on an enabled circuit board. As a result, EMI may interfere with the operation of switch. Further, EMI may emit from opening to interfere with other adjacent devices.

SUMMARY OF THE INVENTION

In view of the foregoing, it is accordingly, an object of the present invention to provide a new and improved DIP switch having a metal cover with a number of risers extended from each of three sides thereof adjacent to DIP switch in which risers are urged against a housing of circuit board when DIP switch is seated on circuit board such that DIP switch is enclosed by metal cover, housing, and circuit board with only an opening provided on housing for setting selectors, and a portion of circuit board under DIP switch is obstructed from outside, thereby preventing an EMI generated by other devices on circuit board from interfering with DIP switch, as well as preventing an EMI generated by the portion of circuit board under DIP switch from emitting out of the opening.

It is another object of the present invention to provide a DIP switch having anti-EMI capability in which a pair of raised members each is provided on either of two opposite sides of metal cover and a pair of recessed members each is provided on either of two opposite sides of DIP switch respectively for tightly securing raised members to recessed members when metal cover is mounted on DIP switch.

It is still another object of the present invention to provide a DIP switch having anti-EMI capability in which at least one pins are provided on two opposite bottom side of DIP switch for tightly securing DIP switch on circuit board by inserting pins into corresponding number of holes on circuit board such that metal cover may connect to ground through holes which have been grounded by means of connection.

The above and other objects, features and advantages of the present invention will become apparent from the following detailed description taken with the accompanying drawings.

DETAILED DESCRIPTION OF PREFERRED EMBODIMENTS

Figure 1:
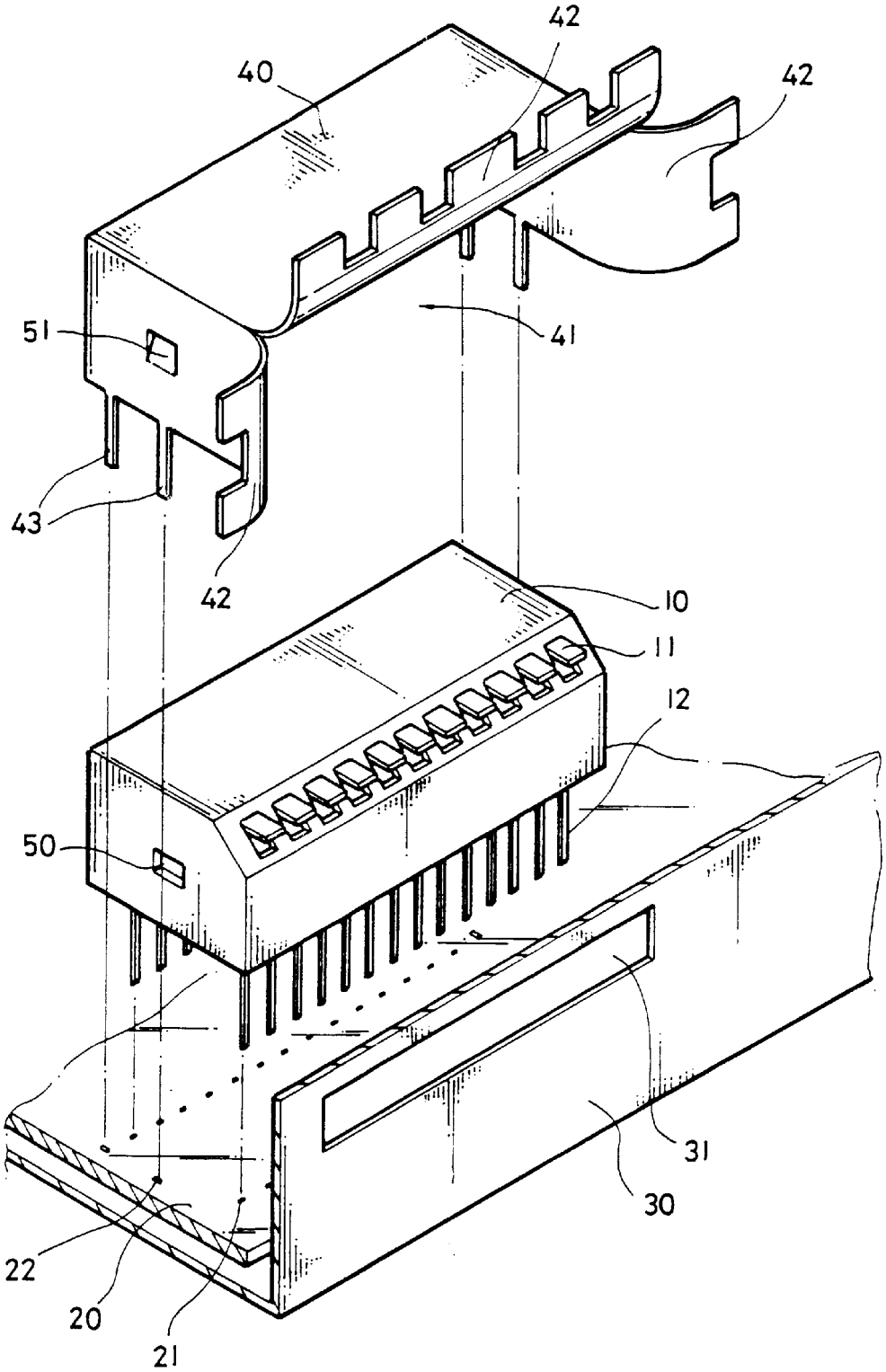
FIG. 1 is a broken apart view of an embodiment of the present invention.
Figure 2:
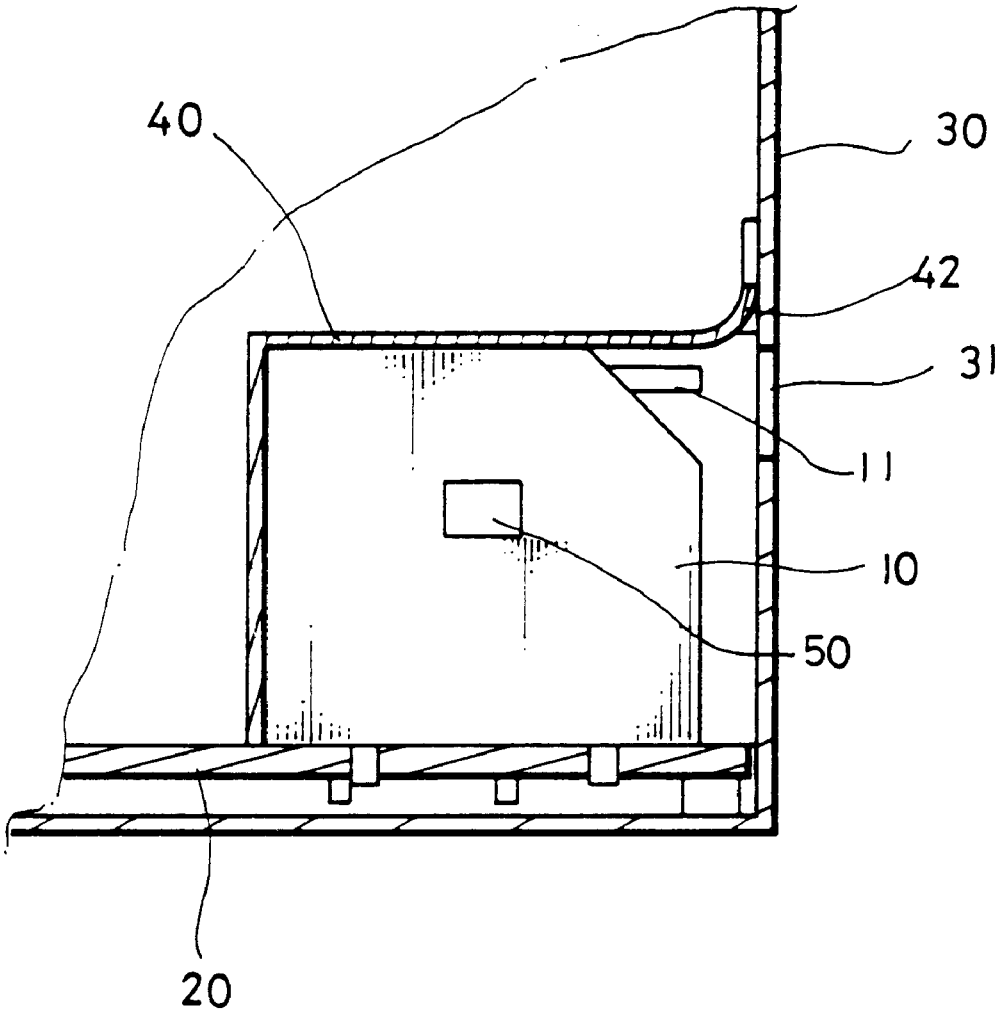
FIG. 2 is a sectional view of FIG. 2 showing DIP switch is secured to circuit board and housing.

Referring to FIGS. 1–2, there is shown a DIP switch 10 having anti-EMI capability provided on a circuit board 10. DIP switch 10 is generally a parallelpiped having a number of selectors 11 disposed side-by-side on a slanted surface between a top surface and a side surface, and a number of pins 12, electrically connected to selectors 11, provided on two opposite side of bottom surface. Circuit board 20 is enclosed by a housing 30 which has, for example a rectangular opening 31 provided on a side surface being disposed corresponding to selectors 11 for permitting an operator to use a finger or a pointed object like a ball-point pen to set DIP switch selectors 11 in order to choose a desired function.

DIP switch 10 is enclosed by a metal cover 40. Metal cover 40 has a front side opening corresponding to selectors 11, a number of flexible risers 42 extended from each of three sides enclosing opening 41, and a number of pins 43 on two opposite sides extended down a predetermined distance. Note that risers 42 may be replaced by other suitable fastening elements by those skilled in the art which is still within the scope of the present invention.

When installed, DIP switch 10 is secured on circuit board 20 by inserting pins 12 into circuit board 20. Metal cover 40 then is secured on circuit board 20 by inserting pins 43 into a corresponding number of holes 22 on circuit board 20 such that metal cover 40 is in contact with DIP switch 10 fully. Further, urges risers 22 against housing 30. It is seen that DIP switch 10 is enclosed by metal cover 40, housing 30, and circuit board 20 with only opening 31 left as the only passage between DIP switch 10 and external. Additionally, DIP switch 10 is connected to ground through the contact of risers 42 with housing 30, and metal cover 40 is connected to ground through the contact of pin 43 with holes 22 of circuit board 20 due to holes 22 have been grounded by means of connection (not specifically shown). Moreover, a portion of circuit board under DIP switch 10 is obstructed from outside, thereby preventing an EMI generated by other devices on circuit board 20 from interfering with DIP switch 10 as well as preventing an EMI generated by the portion of circuit board 20 under DIP switch 10 from emitting out of the opening 31.

A pair of raised members 51 each is provided on either of two opposite sides of metal cover 40 and a pair of recessed members 50 each is provided on either of two opposite sides of DIP switch 10 respectively for tightly securing raised members 51 to recessed members 50 when metal cover 40 is mounted on DIP switch 10.

Note that raised members 51 and recessed members 50 may be replaced by other suitable mating elements by those skilled in the art which is still within the scope of the present invention.

While the invention herein disclosed has been described by means of specific embodiments, numerous modifications and variations could be made thereto by those skilled in the art without departing from the scope of the invention set forth in the claims.

What is claimed is:

1. A switching device comprising:

a circuit board having a plurality of holes;

a DIP switch having a plurality of selectors provided parallel to each other and the DIP switch being secured on the circuit board;

a housing for enclosing the circuit board having a first opening disposed corresponding to the selectors; and a metal cover having a second opening corresponding to the selectors, a plurality of risers extending from each of a first, a second, and a third sides enclosing the second opening, and a plurality of pins on the second and third sides extend downward;

wherein the DIP switch is in contact with the metal cover by inserting the pins into the holes, the risers are urged against the housing such that the DIP switch is enclosed by the metal cover, the housing, and the circuit board with the first and second openings left as an only passage between the DIP switch and outside of the housing and a portion of the circuit board under the DIP switch is obstructed from the outside thereby preventing a first EMI generated by other electrical elements on the circuit board from interfering with the DIP switch as well as preventing a second EMI generated by the portion of the circuit board under the DIP switch from being emitted out of the first opening.

2. The switching device of claim 1, further comprising a pair of raised members each provided on either of the opposite second and third sides of the metal cover and a pair of recessed members each provided on either of two opposite sides of the DIP switch respectively for tightly securing the raised members to the recessed members when the metal cover is mounted on the DIP switch.

3. The switching device of claim 1, wherein the DIP switch is connected to ground through a contact of the risers with the housing, and the metal cover is connected to ground through a contact of the pins with the holes due to the housing and the holes having been grounded.

* * * * *